US007080926B2

(12) United States Patent
Chang

(10) Patent No.: US 7,080,926 B2
(45) Date of Patent: Jul. 25, 2006

(54) INTER-CONNECTED NON-INTERLOCKED CHAIN SHAPE LAMP

(76) Inventor: Chin Chen Chang, No. 9, Lane 305, Pei Ta Road, Hsin Chu (TW)

( * ) Notice: Subject to any disclaimer, the term of this patent is extended or adjusted under 35 U.S.C. 154(b) by 0 days.

(21) Appl. No.: 10/914,853

(22) Filed: Aug. 11, 2004

(65) Prior Publication Data

US 2006/0034066 A1 Feb. 16, 2006

(51) Int. Cl.
*F21S 13/14* (2006.01)

(52) U.S. Cl. ..... 362/252; 362/249; 362/806

(58) Field of Classification Search ..... 362/227, 362/238, 239, 249, 250, 252
See application file for complete search history.

(56) References Cited

U.S. PATENT DOCUMENTS 6,196,701 B1 * 3/2001 Chang ..... 362/252
6,299,332 B1 * 10/2001 Huang ..... 362/363
2005/0105291 A1 * 5/2005 Wu ..... 362/294

* cited by examiner

*Primary Examiner*—Thomas M. Sember
*Assistant Examiner*—Adam C. Rehm

(57) ABSTRACT

A chain shape illumination assembly is provided having a plurality of inter-connecting rings wherein each ring comprises a frame member defining a housing portion and a cover for said housing portion. At least one electrical lamp is secured in each housing and an electrical wire having one end electrically connected to each lamp and another end which passes through an opening in the ring and enters through an opening in an adjacent ring wherein it is connected to the lamp in said adjacent ring.

6 Claims, 6 Drawing Sheets

INTER-CONNECTED NON-INTERLOCKED CHAIN SHAPE LAMP

FIELD OF THE INVENTION

The present invention relates to chain shape lamp and is particularly related to chain shape lamp having non-interlocked chain rings.

BACKGROUND OF THE INVENTION

In my U.S. Pat. No. 6,196,701, I describe a chain shape lamp which consists of several rings strung together as a chain, in which each ring holds one or more light bulbs and associated electrical power cords inside each ring in order to provide an illuminated assembly. Theretofore it was difficult to provide such chain shape lamps due to their complicated structure which required difficult manufacturing procedures. However, in the structure described in my aforementioned patent I describe a chain shape lamp consisting of a string of detachable interlocked rings in which each ring is a hollow tube composed of two detachable portions comprising a lamp and its associated electrical power cord, and the rings are interlocked one into the other as shown in FIGS. 2, 3 and 4 of said patent. Even though the chain shape lamp described therein is a relatively simple structure, I have now discovered an even simpler chain shape lamp structure in which the individual chain rings are inter-connected without being interlocked, thus making it easier to assemble the rings into a chain shape lamp.

OBJECTS OF THE INVENTION

It is an object of the present invention to provide a chain shape lamp which is simple to assemble to form a chain shape lamp.

It is a further object of this invention to provide a chain shape lamp comprising a plurality of individual rings wherein the individual rings are interconnected, one to the next along the chain.

The foregoing and other features of the present invention will become apparent from the ensuing detailed description and the accompanying drawings.

SUMMARY OF THE INVENTION

The chain shape illumination assembly of the present invention is formed by inter-connecting several rings each containing at least one lamp with associated electrical wires. The rings may be the same or dissimilar in shape and are conveniently made of transparent or translucent plastic although they could be metallic as well. Each ring may be tubular or it may be formed of a frame member comprising a housing for locating one or more lamps, and a cover member which mates with or covers the housing member. The rings in the chain are connected by a wire with one end making electrical contact with the lamps in the housing and the other end passing through a slit in the ring and through a slit in the adjacent ring, and so on, thus forming interconnected chain rings. One tail end of the wire is connected to an electrical source for illuminating the lamps while the other extreme tail is plugged to protect the wire.

BRIEF DESCRIPTION OF THE DRAWINGS

In the drawings, wherein like reference numerals are employed to designate like parts.

DETAILED DESCRIPTION OF THE INVENTION

Figure 1:
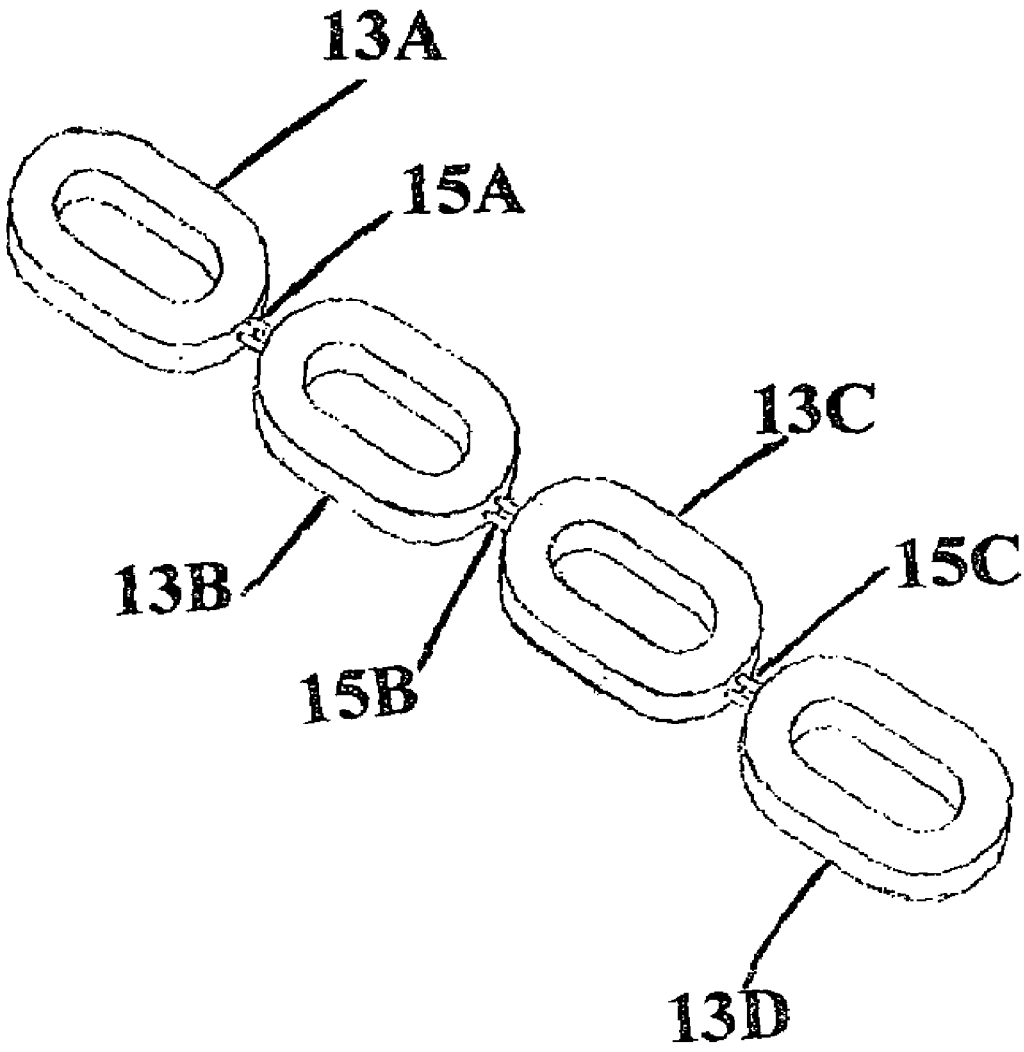
FIG. 1 is a perspective view showing several (4) rings which are interconnected to form a string of interconnected rings defining the chain shape.
Figure 3:
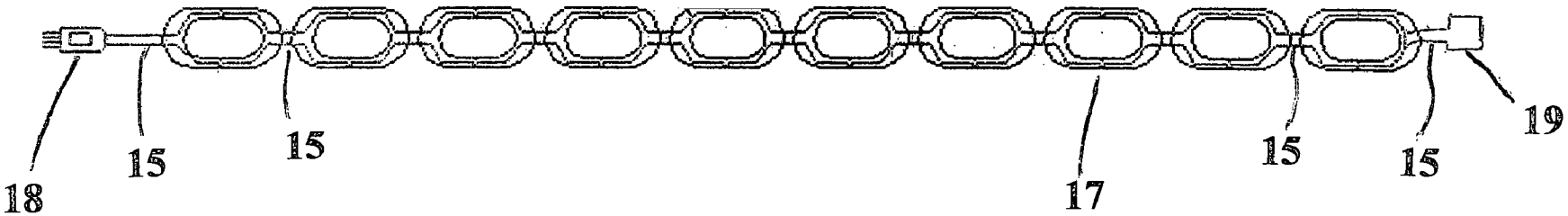
FIG. 3 shows a string of interconnected rings with their top covers removed, without the bulbs, in order to show interconnection of the rings to form a long string of detachable rings which define the chain shape lamp of the present invention.
Figure 4:
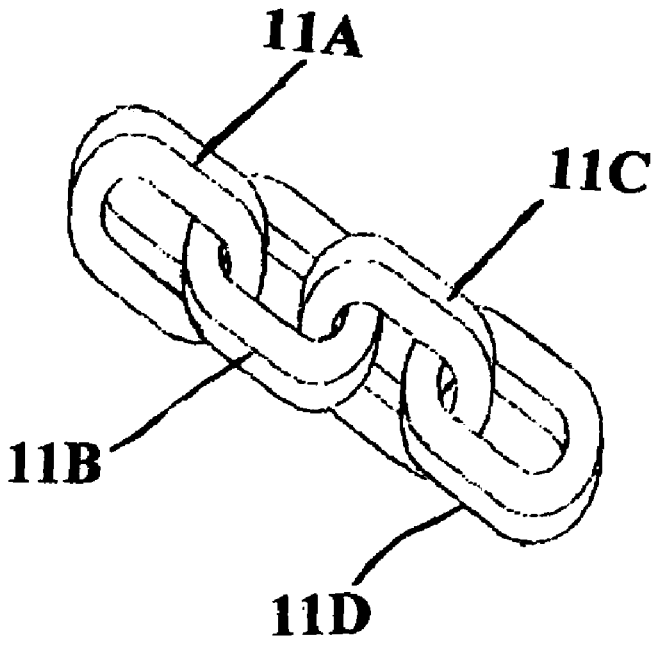
FIG. 4 (PRIOR ART)
FIG. 4 is a perspective view of an interlocking chain formed by interlocking rings as in my aforementioned U.S. Pat. No. 6,196,701.

Referring first to FIG. 4, there is shown a chain of interlocked detachable rings 11A, 11B, 11C and 11D, wherein the individual rings are interlocked as described in my aforementioned patent as shown, for example, by FIG. 4 of that patent. By contrast, in FIG. 1 of the present application, there is shown a chain formed by interconnecting a string of rings such as rings 13A, 13B, 13C and 13D wherein the rings are connected together by the insulated wires 15A, 15B and 15C which wires are electrically connected to lamps located within the rings housings as will hereinafter be defined. Although only four rings are shown forming the chain illustrated in FIG. 1, the chain may consist of as many rings as desired to form the ring chain. This arrangement is illustrated in FIG. 3 which shows a ring chain 17 formed by connecting several successive rings connected together by the wire 15. Portions of the wire 15 are shown in FIG. 1 as the wires 15A, 15B and 15C which connect the rings 13A, 13B, 13C and 13D together. As shown in FIG. 3, one end of the wire 15 terminates in the electrical plug connector 18 which is connected to a source of electrical power (not shown) and the other end of the wire 15 terminates in the end plug 19.

Figure 2:
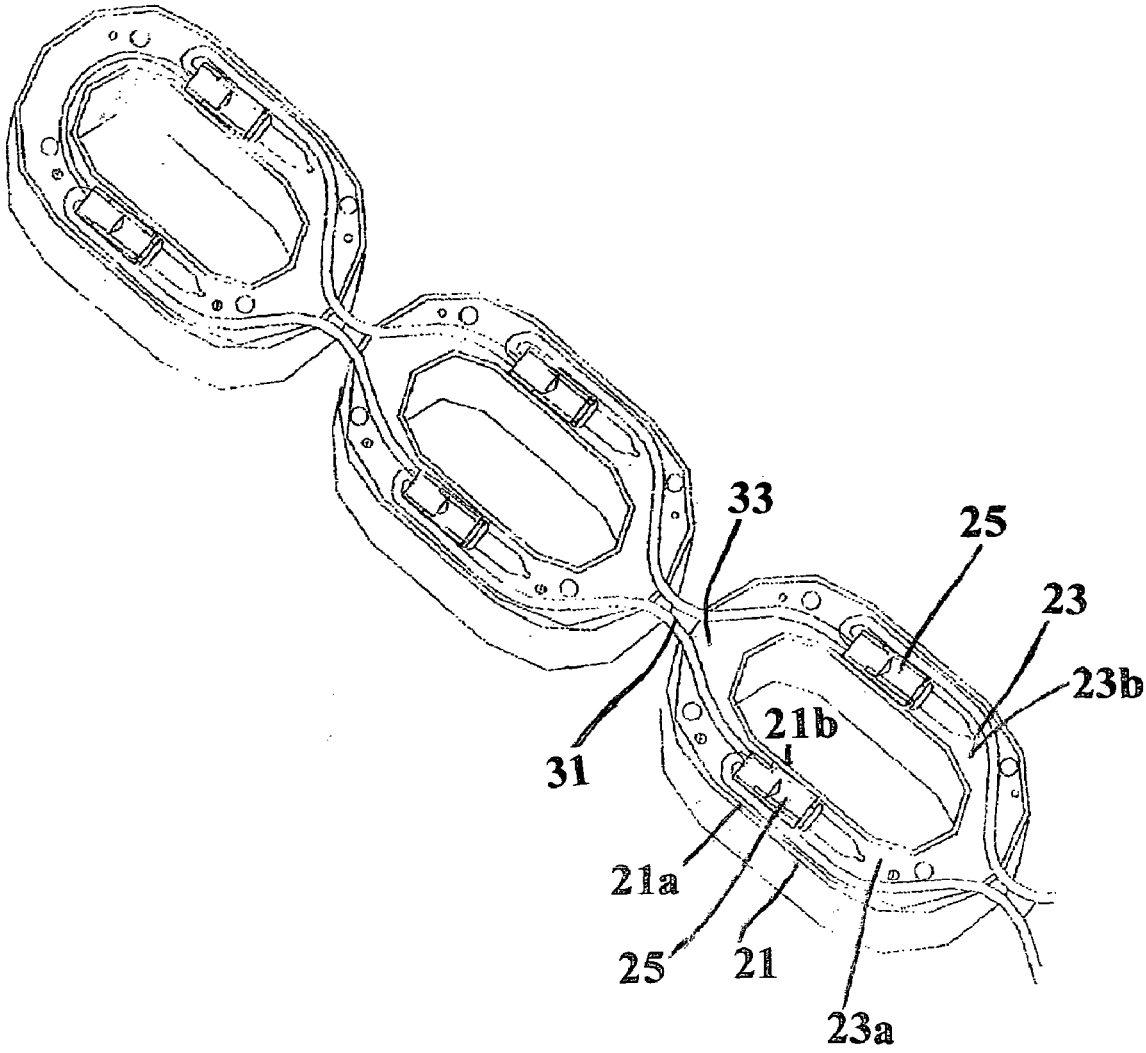
FIG. 2 is a top view of several (3) bottom housing portions of each ring with their top (mating) cover removed to show the positioning of the light bulb and the interconnecting wires.
Figure 5:
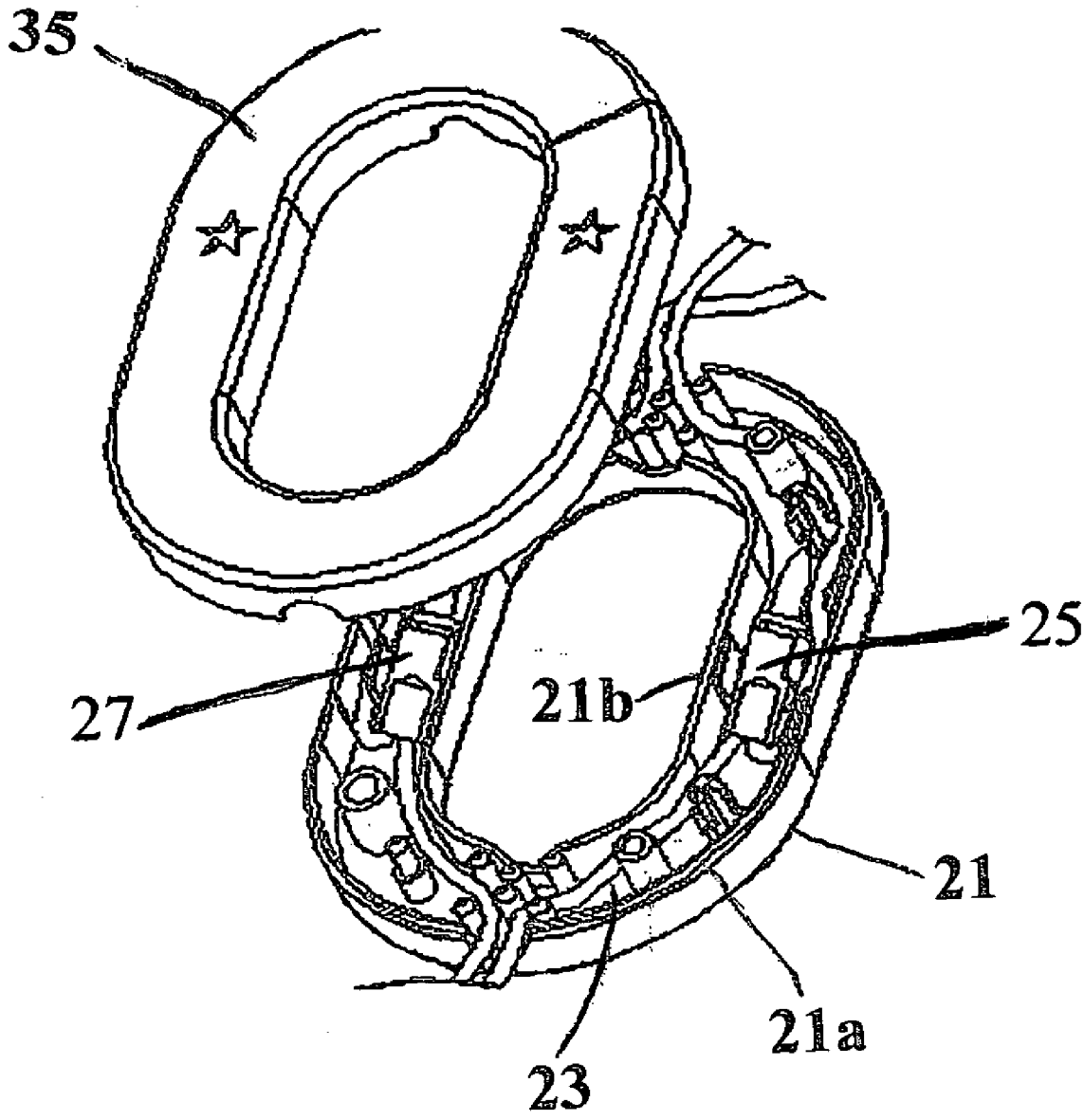
FIG. 5 is a partly perspective and partly exploded view of one ring which forms the chain, with the bottom and top portions separated to show details of the lamps and their associated electrical wire arrangement.
Figure 6:
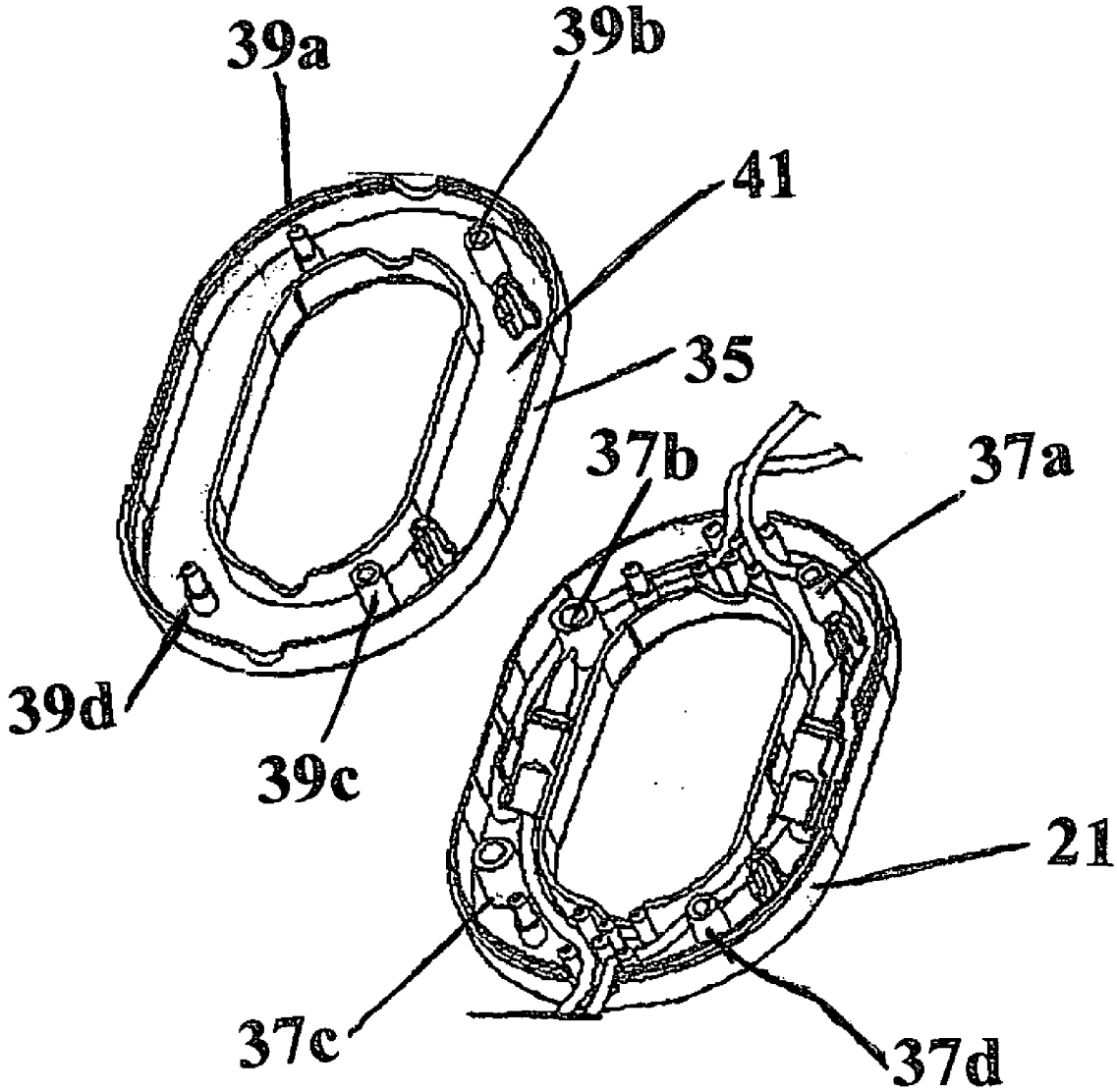
FIG. 6 is a view similar to FIG. 5, with the top cover portion of the ring rotated 180 degrees to show the means for engaging the cover and the bottom portions.

Each of the rings or links used to house the lamps and which, when interconnected, form the chain shape light assembly, is formed of two portions or frames, a first frame or portion housing the lamp and its associated electrical wires, and a second frame or portion which mates with and covers the housing portion. These frames may be pre-molded transparent or translucent plastics fabricated to the desired shape and size or they may be made of metallic or other material although, as a practical matter, a plastic material is preferred. The details of this arrangement are shown in FIGS. 2, 5 and 6. While the two portions or frames are being referred to as top and bottom portions, it must be understood that these portions may be in any position so long as they face each other and one portion mates with or covers the other portion to form the ring or link. Alternatively, the ring may be in tubular form which can house the lamps and their associated electrical wires.

Referring further to FIGS. 2, 5 and 6, each ring such as, for example, the ring 13C comprising the housing portion 21 is shown as elliptical in shape although it could be in some other configuration. The housing portion 21 comprises a raised outer peripheral ridge 21*a* and a raised inner ridge 21*b* which is generally parallel to the outer ridge 21*b* thus defining the channel 23 which comprises the left and right channels 23*a* and 23*b* in each of which is seated or securely positioned a light bulb 25,27. Each of the light bulbs is of the usual construction known in the prior art such as, for example, described in U.S. Pat. No. 6,367,953 or U.S. Pat. No. 6,478,449, and are electrically connected by the power cords or wires 15 which after making electrical contact with the light bulb exist through a side slit 31 and enters the facing side slit 33 in the next adjacent ring. In this manner each ring or link comprises a light bulb and each link is connected to the next adjacent link by the interconnecting wire thus resulting in a chain shape lamp with individual illuminated rings or links.

The cover frame or portion 35 of each link, such as, for example, the link 13*c*, is a generally flat molded plastic adapted to mate with and cover its associated housing (frame) portion. FIG. 6 shows that the mating of the cover portion 35 and the housing portion 21 is achieved by the provision of the upright grooves 37*a*, 37*b*, 37*c* and 37*d* in the housing portion of the ring and the pin members 39*a*, 39*b*, 39*c* and 39*d* in the facing surface 41 of the cover portion. Thus, these two portions may be snapped into one another by inserting the pin members 39*a*, 39*b*, 39*c* and 39*d* into their correspondingly aligned groove members 37*a*, 37*b*, 37*c* and 37*d*.

While the ring portion of the chain has been described with some particularity, it must be understood that other rings or links may be used to form the chain lamp. For example, the housing portion and the cover portion may be formed such that their mating surfaces are removably adhered to one another so long as the light bulbs can be removed and replaced when necessary without destroying the ring structure or the assembly. Other ring structures are obvious from the detailed description herein for providing the interconnected chain shape lamp or the present invention. Also, one or more lamps may be placed in each housing portion but, as a matter of convenience no more than two lamps are usually used.

The invention claimed is:

1. A chain shape illumination assembly comprising a plurality of inter-connected non-interlocked rings wherein each ring comprises a housing, at least one electrical lamp in said housing, an insulated electrical wire having a first end electrically connected to said lamp and a second end passing through a slit provided in said ring and entering an adjacent ring through a slit provided in said adjacent ring, said electrical wire being connected to the electrical lamp in said adjacent ring thereby inter-connecting adjacent rings and forming a chain ring.

2. A chain shape illumination assembly as in claim 1, wherein each said rings is a tubular member and each of said electrical lamps is disposed within said tubular member.

3. A chain shape lamp illumination assembly comprising a plurality of inter-connected non-interlocked rings wherein each ring comprises two frame members, one frame member defining a housing portion and the other frame member defining a cover portion for said housing portion, at least one electrical lamp in said housing portion, an insulated electrical wire having a first end electrically connected to said lamp and a second end passing through a slit in said ring and entering an adjacent ring through a slit provided in said adjacent ring, said electrical wire being connected to the electrical lamp in said adjacent ring thereby inter-connecting adjacent rings and forming a chain ring.

4. A chain shape illumination assembly as in claim 3 wherein said housing portion comprises an inner peripheral channel having a first side channel and a second substantially parallel side channel, an electrical lamp in each of said side channels, two insulated electrical wires, one for each lamp, each one of said electrical wires having a first end connected to a lamp and a second end passing through said slit in said ring and entering adjacent ring through a slit in said adjacent ring with each one being electrically connected to a lamp in respective channels in said adjacent ring thereby inter-connecting adjacent rings and forming a chain ring.

5. A chain shape illumination assembly as in claim 4 wherein cover portion has a facing surface adapted to cover said housing portion, said facing surface having means for engagement with correspondingly aligned engagement means in said peripheral channel of said housing portion.

6. A chain shape illumination assembly as in claim 5 wherein said cover portion has a facing surface adapted to removably cover said housing portion.

* * * * *